US007971296B2

(12) United States Patent
Jansen

(10) Patent No.: US 7,971,296 B2
(45) Date of Patent: Jul. 5, 2011

(54) STIMULATION ACTUATOR FOR MOVING SUPPORTING SURFACES

(75) Inventor: Klaus Jansen, Buxtehude (DE)

(73) Assignee: Thomas Hilfen Hilbeg GmbH & Co. KG (DE)

( * ) Notice: Subject to any disclaimer, the term of this patent is extended or adjusted under 35 U.S.C. 154(b) by 214 days.

(21) Appl. No.: 11/915,192

(22) PCT Filed: May 9, 2006

(86) PCT No.: PCT/EP2006/004298

§ 371 (c)(1),
(2), (4) Date: Aug. 27, 2009

(87) PCT Pub. No.: WO2006/125522

PCT Pub. Date: Nov. 30, 2006

(65) Prior Publication Data

US 2009/0320463 A1 Dec. 31, 2009

(30) Foreign Application Priority Data

May 26, 2005 (DE) ..... 20 2005 008 457 U
Jul. 22, 2005 (DE) ..... 20 2005 011 767 U

(51) Int. Cl.
*A61G 7/057* (2006.01)

(52) U.S. Cl. ..... 5/612; 5/241; 5/244; 5/109; 5/934; 601/98

(58) Field of Classification Search ..... 5/236.1–243, 5/108, 109, 612, 934, 935; 601/51, 53, 54, 601/90, 98, 100

See application file for complete search history.

(56) References Cited

U.S. PATENT DOCUMENTS

| | | | | | |
|---|---|---|---|---|---|
| 178,038 | A | * | 5/1876 | Winne | 5/242 |
| 5,058,224 | A | * | 10/1991 | Aschwanden et al. | 5/238 |
| 5,075,912 | A | | 12/1991 | Elmalek et al. | |
| 5,109,558 | A | * | 5/1992 | Di Blasi | 5/611 |
| 5,210,889 | A | * | 5/1993 | Wesemann et al. | 5/236.1 |
| 5,265,290 | A | * | 11/1993 | Van Raemdonck | 5/236.1 |
| 6,029,294 | A | | 2/2000 | Saringer et al. | |
| 7,552,491 | B2 | * | 6/2009 | Voelker | 5/612 |
| 2004/0231051 | A1 | | 11/2004 | Jansen et al. | |

FOREIGN PATENT DOCUMENTS

| | | | | |
|---|---|---|---|---|
| DE | 38 27 028 | A1 | | 2/1990 |
| DE | 40 230 289 | A1 | | 1/1992 |
| EP | 445325 | A1 | * | 9/1991 |
| EP | 0 487 157 | A1 | | 4/1992 |

* cited by examiner

*Primary Examiner* — Michael Trettel
(74) *Attorney, Agent, or Firm* — Laurence P. Colton; Smith Risley Tempel Santos LLC

(57) ABSTRACT

Stimulation actuators that exert any desired movements on the underspringing arrangement. The underspringing arrangement has lifting members (11) that are mounted elastically by means of elastic elements (14). The elastic elements (14) are arranged such that at least a main direction of work extends at an angle with respect to the direction of the movement of the lifting member. In this way, the lifting member (11) can have a particularly low overall height. The supporting surface of the underspringing arrangement can be moved up and down by the lifting member (11) and the elastic element (14), thereby permitting an individual stimulation and movement of a person lying on the mattress.

16 Claims, 4 Drawing Sheets

STIMULATION ACTUATOR FOR MOVING SUPPORTING SURFACES

STATEMENT OF RELATED APPLICATIONS

This application is the U.S. National Phase Under Chapter II of the Patent Cooperation Treaty (PCT) of PCT International Application No. PCT/EP2006/004298 having an International Filing Date of 9 May 2006, which claims priority on German Patent Application Nos. 20 2005 008 457.3 having a filing date of 26 May 2005 and 20 2005 011 767.6 having a filing date of 22 Jul. 2005.

BACKGROUND OF THE INVENTION

1. Technical Field

The invention relates to a simulation actuator for moving surfaces for sitting on, standing on or lying on, used on mattresses, furniture or the like. The invention further relates to a microstimulation system with one or more stimulation actuators of this kind.

2. Related Art

Underspringing arrangements are known for mattresses or the like of furniture for sleeping on, lying on and/or sitting on, said arrangements having resilient slats which act as support elements for the mattresses and which, at opposite ends, are elastically mounted via elastic bearing means on a frame or on other fixed objects. The slats extend parallel to one another and are at fixed, usually equal distances apart. By modifying the elasticity of the bearing means, the spring properties of the underspringing arrangement can be adapted to the requirements of a person lying on the mattress or the like.

Individuals whose powers of perception are limited or disturbed, for example as a result of being unconscious, individuals whose mobility is severely restricted, including those at risk of developing bedsores and/or those suffering from chronic pain, are exposed to various problems arising from prolonged periods of confinement to bed. These problems mainly involve lack of stimulus, bedsores and pain caused by being kept in a lying position. Although known underspringing arrangements for mattresses or the like can be adapted in terms of their elasticity behavior to the needs of the particular individual, the above problems are not solved, or are at any rate not adequately solved, by said arrangements.

As a solution to these problems, German patent application DE 101 48 569 proposes that the ends of the slats of an underspringing arrangement for mattresses or the like are assigned stimulation actuators with lifting members with which the slats are moved up and down individually, which leads to an individual stimulation and movement of the person lying on the mattress. The lifting members are designed as bellows-type hollow bodies, with the slat ends being clipped onto the tope face of the hollow bodies. The hollow bodies are moved by means of a fluid, in the simplest case air, which is able to flow into and out of the hollow bodies. Starting from a central fluid pressure source, normally a compressor, the fluid is delivered to the bellows-type hollow bodies via respective fluid lines. A disadvantage of this underspringing arrangement and of the individual stimulation actuators is in particular the need to provide a large number of fluid pressure lines that connect the hollow bodies to the central fluid pressure source. In addition to the complex routing of the fluid lines, there is a risk of leaks occurring.

BRIEF SUMMARY OF THE INVENTION

Preceding from this prior art, the object of the present invention is to create stimulation actuators which are able to move supporting surfaces of mattresses, furniture or the like, particularly surfaces for sitting on, standing on or lying on, and with which it is possible to achieve the most targeted and effective movement of the supporting surfaces. The stimulation actuators are in particular to be designed to take up as little space and/or to function as safely as possible.

A stimulation actuator for achieving this object is a stimulation actuator for moving supporting surfaces, in particular surfaces for sitting on, standing on or lying on, used on mattresses, furniture or the like, which stimulation actuator has a movable lifting member, characterized in that the lifting member is mounted elastically by means of an elastic element, the elastic element being arranged such that at least a main direction of work thereof extends at an angle, preferably substantially transversely, with respect to the direction of the movement of the lifting member. The lifting member is mounted elastically on the stimulation actuator by means of an elastic element, the elastic element being arranged in such a way that at least a main direction of work thereof extends at an angle, preferably substantially transversely, with respect to the direction of the movement of the lifting member. On account of the elastic bearing of the lifting member, the stimulation actuators are advantageously not designed rigid with respect to the counter-pressure generated, for example, by a person lying on the supporting surface of a mattress, and instead they yield resiliently or elastically within certain limits. Since the main direction of work of the elastic element is oriented at an angle, i.e. not parallel, to the direction of the movement of the supporting surface, the lifting member can have a particularly low height.

In the context of the invention, the stimulation actuator can lead directly or indirectly to the movement of the supporting surface. For example, the stimulation actuator can move a support element up and down, for example a slat of an underspringing arrangement of a bed, which in the end leads to a corresponding movement of the respective supporting surface, namely the supporting surface of the mattress arranged on the underspringing arrangement. It is also conceivable to fit the stimulation actuators directly into a mattress, such that they can act on the inside of the mattress surface. The stimulation actuators can also be integrated, for example, in the armrests or backrest of a chair such that the supporting surfaces thereof are moved by the elements. Many different uses and functions are possible.

In the context of this application, the term "lifting member" is to be understood as any form of constantly moving and/or movable structural part of the stimulation actuator that can effect a movement, in particular an upward and downward movement, of the supporting surface that is to be moved. The lifting member does not necessarily have to be moved in the same way as the supporting surface that is to be moved, and instead it can, for example, also execute swiveling movements which lead to an upward and downward movement of the supporting surface.

In a preferred embodiment of the present invention, the elastic element can be subjected to a pretensioning. The stimulation actuator in this case advantageously has an adjustment actuator which interacts with the elastic element in such a way that the pretensioning can be modified preferably steplessly. The pretensioning can in particular be periodically increased or decreased. If the elastic element is a helical spring, for example, the adjustment actuator can move the spring, for example via a tensioning band, out from the rest position and/or out (further) from an already pretensioned position and can swing back as the tensioning bank relaxes. By corresponding operating connections to the lifting member, a movement of the lifting member is effected by the execution or backward swing of the spring. Periodic changes of the pretensioning by the adjustment actuator can be superposed here by various constant pretensionings, which lead to different stiffness of the supporting surface of the mattress, furniture or the like elastically mounted by means of the stimulation actuators.

In a particular embodiment, the adjustment actuator itself comprises a linear actuator, in particular a spindle. However, it can also have an eccentric, a crank mechanism or a wound-up band. The adjustment actuator is driven by electromotive or electrohydraulic means in this case. Alternatively, an electromotive or electrohydraulic drive can be omitted if a so-called shape-memory actuator is used. This utilizes the property of a shape-memory metal to change dimensions and shape when the metal is cooled and/or heated.

In another embodiment of the present invention, representing an alternative or addition to the pretensioning of the elastic element, the stiffness of the latter is modified along the main direction of work. In contrast to the case of pretensioning, therefore, the "spring constant" of the elastic element is changed directly.

In a preferred embodiment, the lifting member comprises an angled lever which is able to swivel about a swivel axis and which ahs at least two lever arms, of which one lever arm can be assigned to the supporting surface, for the purpose of moving the latter, while the other lever arm is operatively connected to the elastic element. The elastic element can in this case be operatively connected in particular in such a way that a change of its pretensioning, in particular an increase and/or decrease, causes a movement of the angled lever about the swivel axis. The lever arm assigned to the supporting surface, and which in its simplest form bears on the underside of the latter, is thus set in movement, which leads to a corresponding movement of the supporting surface.

As regards the elastic element, various configurations are possible. The elastic element is preferably designed as or comprises a torsion spring, for example a helical spring, a rubber spring, an elastic bank, a toggle spring, an annular spring, a hydraulic spring, a gas spring or a shape-memory spring.

Another stimulation actuator for achieving the aforementioned object is a stimulation actuator for moving supporting surfaces, in particular surfaces for sitting on, standing on or lying on, used on mattresses, furniture or the like, in particular, which stimulation actuator has a movable lifting member, characterized in that the stimulation actuator has an electric motor that drives the lifting member. Such stimulation actuators are distinguished in particular by a compact structure. Compared to the prior art, fluid lines that have to be routed form a central pressure source to the stimulation actuator are not needed.

The lifting member is preferably designed as a bellows-type hollow body, and the movement of the bellows-type hollow body, in particular the upward and downward movement, is effected by an electrohydraulic and/or electropneumatic drive driven by the electric motor. The fluid movements needed for the movement of the bellows-type hollow body are accordingly generated by the stimulation actuator in direct proximity to the hollow bodies, in particular without a central pressure source.

The bellows-type hollow body advantageously has resiliently elastic properties (spring properties) here. Alternatively or in addition, a gas spring or air spring system can be provided for the spring-mounting of the lifting member, in particular of the bellows-type hollow body.

Another stimulation actuator for achieving the aforementioned object is a stimulation actuator for moving supporting surfaces, in particular surfaces for sitting on, standing on or lying on, used on mattresses, furniture or the like, which stimulation actuator has a movable lifting member, characterized in that the lifting member has a shape-memory spring, and the movement of the lifting member can be effected by the heating and/or cooling, and resulting changes in dimension, of the shape-memory spring. The supporting surface to be moved can in this case be moved by a stimulation actuator with lifting member assigned to the supporting surface, the lifting member having a shape-memory spring, and the movement of the lifting member being effected by heating and/or cooling and by the resulting changes in dimensions of the shape-memory spring. Accordingly, there is advantageously no need for an electric motor for driving the lifting member.

A shape-memory spring of this kind, which is composed of a NiTi alloy for example, can have its dimensions changed by heating or cooling it. These changes in dimension are used to cause an upward and downward movement of the lifting member. To optimize the dynamics of the system, i.e. to bring about the greatest possible number of changes of state of the shape-memory spring within the shortest possible time, it can be cooled by a Peltier element assigned to the lifting member. An electric heating system can be provided separately for the heating phases.

The shape-memory spring is advantageously arranged inside a bellows-type hollow body, in particular a thermally insulated one.

The present application relates also to a microstimulation system with one or more of the aforementioned stimulation actuators and with a preferably central control unit for controlling the elements. The movements of the individual stimulation actuators can preferably be controlled individually. The control unit can here be configured such that the supporting surface of the lifting members, which move up and down, of the stimulation actuators can, for example, be moved in successor in a wave movement. As a person skilled in the art will recognize, the control unit can generate a large number of movement patterns or stimulation patterns, in particular by means of suitable control programs. The upward and downward movement of the lifting members then leads to corresponding stimulations of the supporting surface.

The aforementioned microstimulation system is suitable in particular for treatment of bedsores and prevention of bedsores, for improving perception, for preventing lack of stimulus, for backup in pain treatment and/or for obtaining and reproducing the schematogram. The microstimulation system according to the invention and the individual stimulation actuators here permit a stimulation of the mattress of a bed, and the respective stimulation transmits itself to a person lying on this mattress. Different stimulations afforded by minimal stimuli and conceivable, for example vestibular, vibratory, auditory, tactile/haptic, postural and/or visual.

BRIEF DESCRIPTION OF THE DRAWING FIGURES

The following illustrative embodiments show further features of the invention on the basis of an exemplary use of an underspringing arrangement on a bed on which stimulation actuators act. In the attached drawings.

DETAILED DESCRIPTION OF PREFERRED EMBODIMENTS

Figure 1:
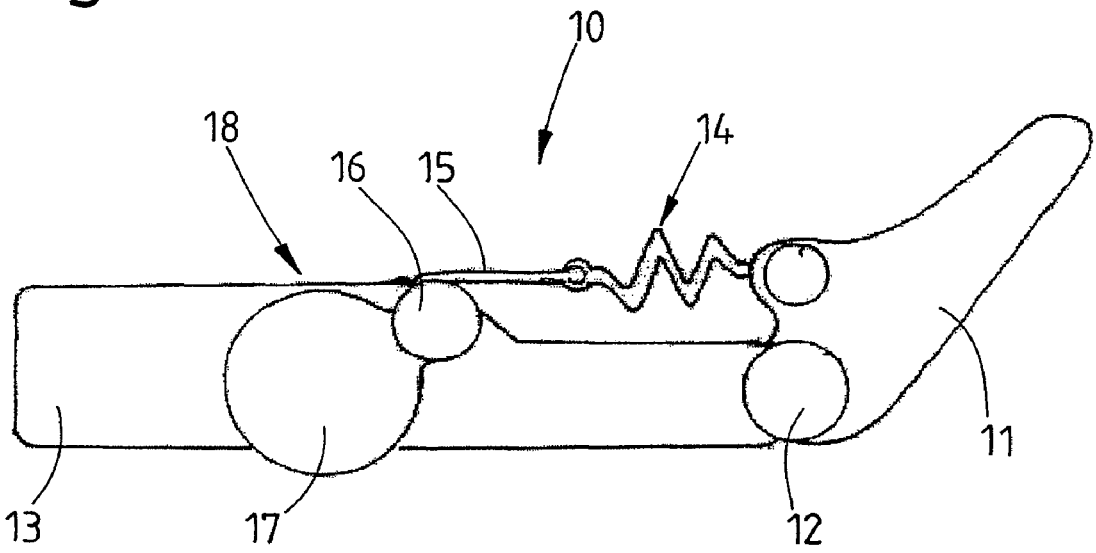
FIG. 1 shows a side view of a stimulation actuator with motor drive.

FIG. 1 shows a (micro)stimulation actuator 10 for moving and elastically mounting the supporting surfaces of furniture for sleeping on, lying on or sitting on, used on a mattress or the like. The stimulation actuators according to the invention are described below on the basis of an example of an underspringing arrangement for mattresses. The stimulation actuators can, however, be used in many other variants for moving supporting surfaces. For example, they can be installed directly into the mattress itself, or into the armrests or backrests of chairs or the like.

An underspringing arrangement for mattresses usually has resilient slats that are mounted elastically at opposite ends on a frame or on other fixed objects by way of elastic bearing means. These resilient slats then form the support elements for the mattress. The slats in this case extend parallel to one another, with fixed and usually identical spacing between them. In addition, to resilient slats, other support elements are known, for example individual supporting plates. The stimulation actuators can be provided at any desired positions of the underspringing arrangement and in particular in any desired number. In the context of the invention, it is therefore possible for only a few support elements, or in extreme cases all of the support elements, to be moved by the stimulation actuators.

The stimulation actuator 10 has a lifting member 11 designed as a swivel lever. The lifting member 11 is connected pivotably, by way of a swivel axis 12, to the end portion of a motor housing 13 of the stimulation actuator 10 comprising an electric motor. Above the swivel axis 12, the lifting member 11 is connected to one end of an elastic element 14 designed as torsion spring. The other end of the elastic element 14 is connected by a tensioning member 15, namely a tensioning band or tensioning cable, to a roller of a winding device, of which the rotation axis 16 is shown. The main direction of work of the elastic element 14, namely the longitudinal center axis of the torsion spring, extends parallel to the tensioning direction of the tensioning bank 15. The winding device is connected to the motor of the stimulation actuator 10 via a schematically illustrated gear 17. In particular the motor, the gear 17, the tensioning member 15 and the winding device are part of an adjustment actuator 18 for modifying the pretensioning of the elastic element 14.

In the oblique position of the lifting member 11 shown in the illustration, its force of gravity alone is enough to effect a first pretensioning of the elastic element 14 in the main direction of work. During use, the swivel lever 11 pointing upward in the illustrated oblique position rests on a support element (not shown) of the underspringing arrangement. A winding-up of the tensioning band 15, effected by the motor drive, causes an excursion, i.e. further additional pretensioning of the elastic element 14 from the already slightly pretensioned state. Assuming that no counter-pressure or only a negligible counter-pressure acts on the operatively connected support element, the swivel lever 11 pivots upward and, in so doing, lifts the support element of the underspringing arrangement, in the simplest case the resilient slat, usually in a perpendicularly upward movement. A subsequent unwinding of the tensioning band 15 allows the elastic element 14 to swing back from the pretensioned position on account of the restoring force of the spring, which leads to a downward pivoting of the swivel lever 11 and, consequently, to a lowering of the support element. In the present embodiment, the main direction of work of the elastic element 14, in other words the direction in which the restoring force preferably acts, advantageously extends at an angle, namely almost transversely, with respect to the upward and downward movement of the support element.

The stimulation actuator 10 performs two functions in particular. On the one hand, it allows the support elements of the underspringing arrangement, and thus the mattress or the like arranged thereon, to move up and down in particular periodically and/or according to predefined patterns, and, on the other hand, it serves as an elastic bearing on the support elements. Alternatively or in addition to the stimulation movements of the support elements, different degrees of stiffness of the bearing of the support elements can accordingly be set by means of static changes in the pretensioning of the elastic element 14.

Further illustrative embodiments of stimulation actuators are described below which each likewise perform the described functions. For simplicity, equivalent structural parts to those in the embodiment according to FIG. 1 are provided with identical reference numbers here.

Figure 2:
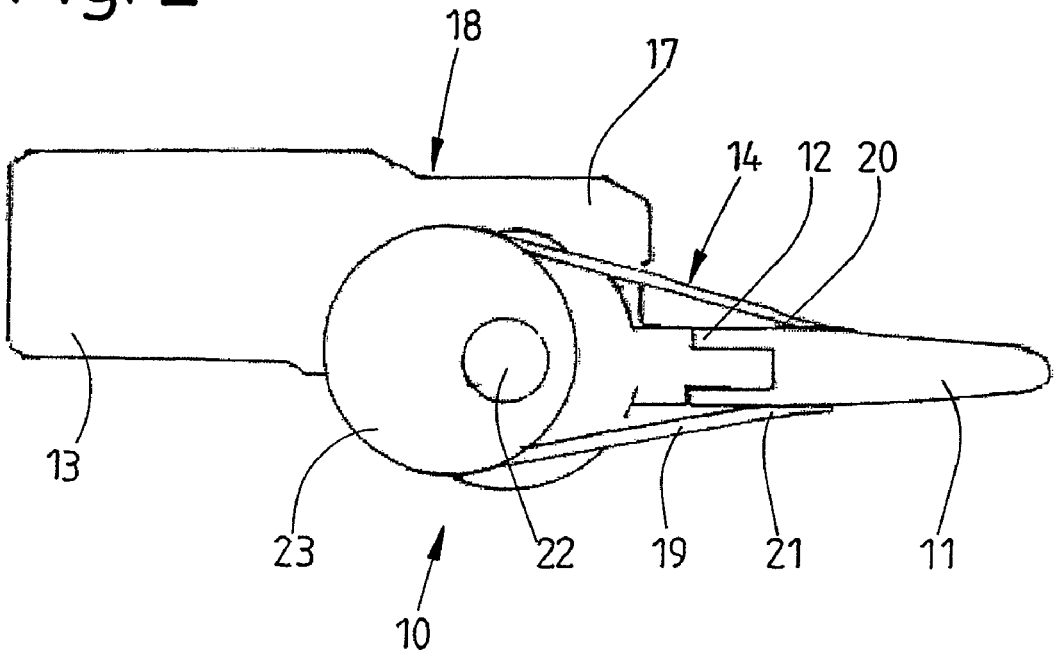
FIG. 2 shows a plan view of another embodiment of a stimulation actuator with motor drive.

The stimulation actuator 10 shown in a plan view in FIG. 2 differs from the stimulation actuator according to FIG. 1 in particular in terms of the adjustment actuator 18 and the elastic element 14. Instead of a torsion spring, a tensioning band 19 with spring properties is provided as the elastic element 14. Above the swivel axis of the lifting member 11, two portions 10, 21 of the tension band 19 engage thereon, in each case to the left and right, and are connected to it. The remaining part of the tensioning band 19 is guided around an eccentric disk 23 which is driven by a motor/gear unit and can rotate about an axis 22. By moving the eccentric disk 23 about the rotation axis 22, the tensioning band 19, depending on the position of the eccentric disk 23, is either subjected to an additional pretensioning, i.e. travels counter to the spring restoring force, or, conversely, is released from the pretensioned position such that the spring restoring forces of the tensioning band 19 come into action. Upon additional pretensioning of the tensioning band 19, the lifting member 11 is moved upward about the swivel axis 12, i.e. out of the plane of the drawing. Upon relaxation of the tensioning band 19, the lifting member 11 is moved downward, i.e. into the plane of the drawing.

Figure 3:
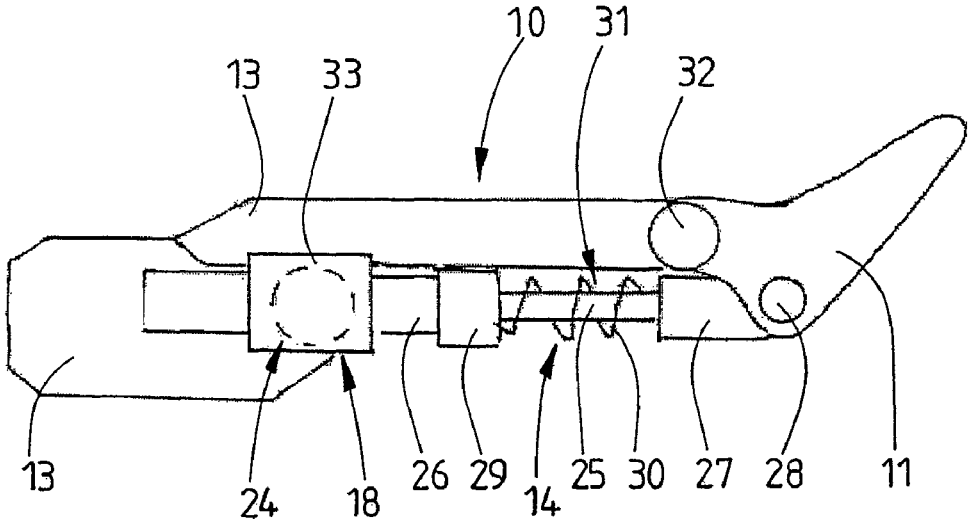
FIG. 3 shows a side view of another embodiment of a stimulation actuator with motor drive.

In contrast to the stimulation actuator according to FIG. 1, the stimulation actuator 10 according to FIG. 3 has, at its adjustment actuator 18, a linear actuator 24 with which the lifting member 11 is swiveled. An end portion of a rod-shaped piston element 25 is for this purpose guided movably in a straight line inside a cylinder element 26 of the linear actuator 24. The other end of the rod-shaped piston element 25 is connected in one piece to a flange-like end portion 27, which in turn is connected pivotably to the lifting member 11 via a swivel axis 28. On the side facing toward the lifting member 11, the cylinder element 26 has a cylindrical limit flange 29. Between this limit flange 29 and the flange-like end portion 27, an elastic element 14 designed as a torsion spring 30 surrounds the visible portion 31 of the rod-shaped piston element 25, this is to say that portion not arranged inside the cylinder element 26, along the entire length of said portion.

The lifting member 11 is pivotably connected to an end portion of the motor housing 13 by way of a further swivel axis 32 arranged above the swivel axis 28.

The cylinder element 26 can be moved relative to the longitudinal axis of the motor housing 13 by means of a spindle drive 33. By moving the cylinder element 26 in the direction of the lifting member 11, the cylindrical limit flange 29 moves in the direction of the torsion spring 30, relative to the piston element 25 guided in a straight line inside the cylinder element 26, until the restoring force effected by compression of the torsion spring 30 is so great that further movement of the cylinder element 26 leads to the lifting member 11 being swiveled upward about the swivel axis 32.

Figure 4:
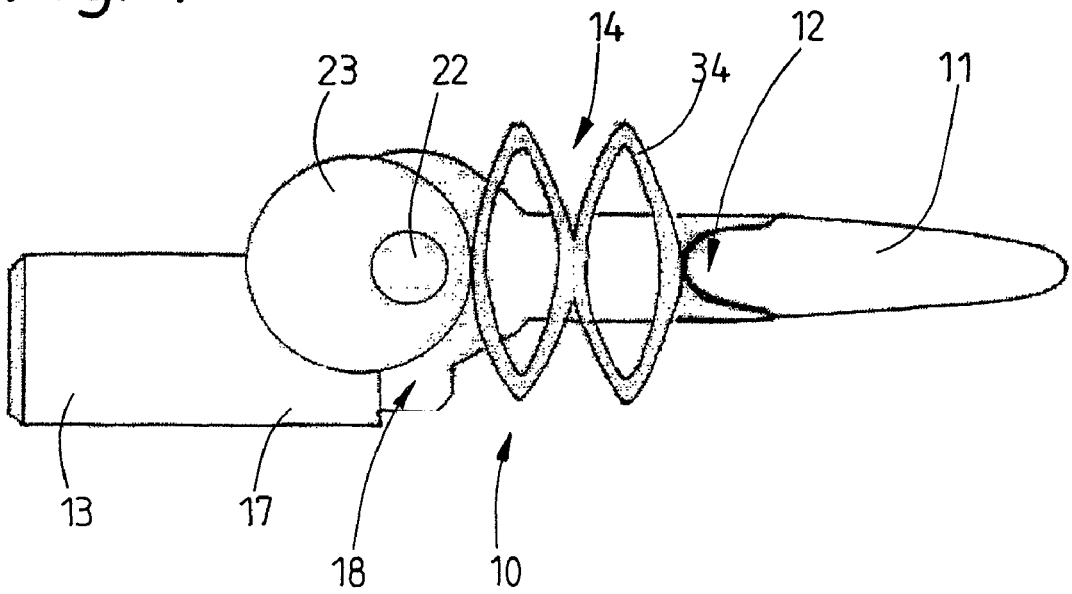
FIG. 4 shows a plan view of another embodiment of a stimulation actuator with motor drive.

FIG. 4 shows a plan view of a stimulation actuator 10 whose adjustment actuator 18, compared to the stimulation actuator according to FIG. 2, has, at its elastic element 14, an annular spring 34 composed of to connected single rings. An eccentric disk 23 exerts a greater or lesser degree of pressure on the annular spring 34, depending on its position. The annular spring 34 is operatively connected to the lifting member 11, which is swiveled upward or downward depending on the position of the eccentric disk 23.

Figure 5:
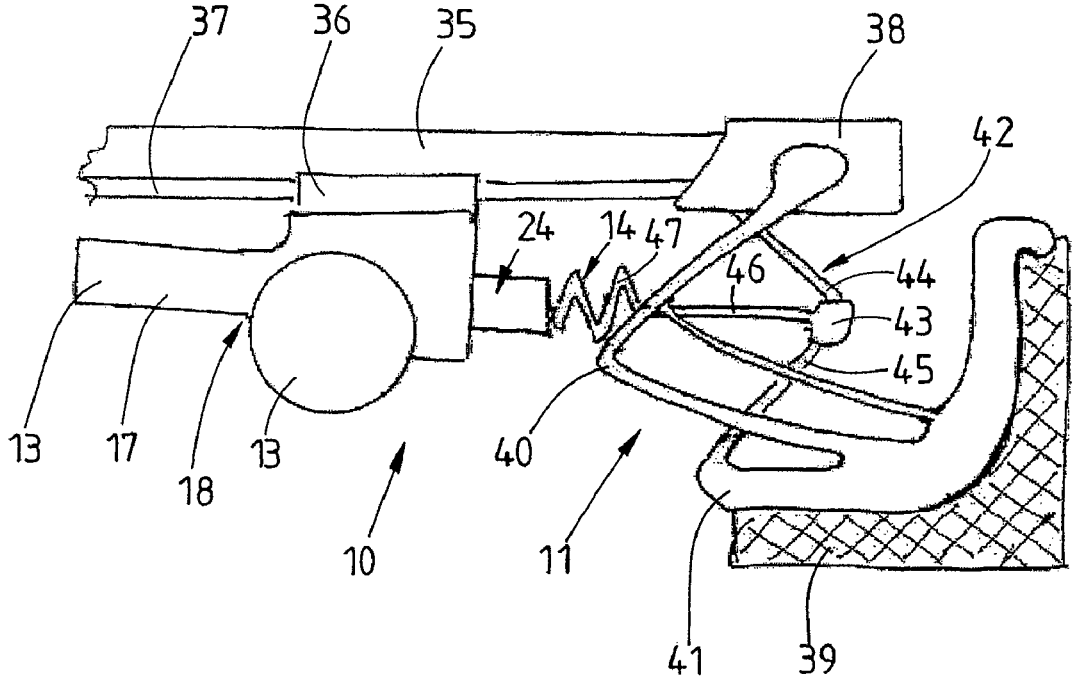
FIG. 5 shows a side view of another embodiment of a stimulation actuator with motor drive.

FIG. 5 shows another embodiment of a stimulation actuator 10 in a side view. A motor housing 13 of the stimulation actuator 10 is secured on a support element, designed as a resilient slat 35, of an underspringing arrangement, of which only a part is shown. For this purpose, an elastic clip 36 is arranged on the top face of the motor housing 13 and engages resiliently with corresponding clip arms in grooves 37 of the resilient slat 35. The grooves extend on both sides of the resilient slat 35, parallel to the longitudinal extent thereof. The invention is of course not limited to this form of connection, and instead many different solutions are conceivable for connecting the stimulation actuators to the support element or to other structural parts of the underspringing arrangement.

A bearing head 38, namely a connective sleeve, is arranged at the end of the resilient slat 35, and the end of the resilient slat 35 is inserted into it. The bearing head 38 is resiliently connected via an elastic lifting member 11 to a profile 39 extending in the longitudinal extent of the underspringing arrangement. The profile 39 can, for example, be the longitudinal spar of a conventional bedframe. The elastic lifting member 11 has a first resilient bearing arm 40 which creates a direct elastic bearing of the bearing head 38 and thus of the resilient slat 35 on the profile 39. For this purpose, the bearing arm 40 merges in one piece into a longitudinal profile 41, which is fixed connected to the profile 39 in the longitudinal extent thereof. The elastic lifting member 11 has a second bearing arm 42 designed as a toggle. Starting from a toggle joint 43, the toggle 42 is operatively connected to the bearing head 38 via an upper toggle arm 44. A lower toggle arm 45 starting from the toggle joint 43 in connected to the longitudinal profile 41. Finally, a middle toggle arm 46 starting from the toggle joint 43 is connected via an elastic element 14, namely a torsion spring 47, to a linear actuator 24 designed as a tensioning spindle.

By moving the tensioning spindle toward the lifting member 11 or away from the lifting member 11, the pretensioning of the elastic element 14 is modified. As a result, the toggle 42 experiences forces in the direction of work of the elastic element 14, which leads to a compression or a stretching of the whole lifting member 11 and, consequently, to an upward and downward movement of the resilient slat 35.

Figure 6:
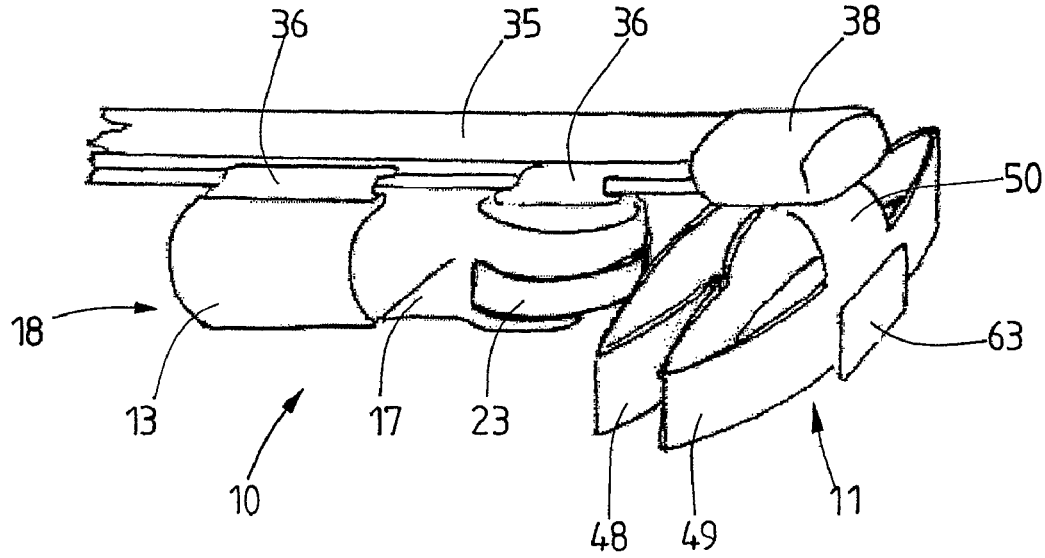
FIG. 6 shows a perspective view of another embodiment of a stimulation actuator with motor drive.

FIG. 6 shows another embodiment of a stimulation actuator 10. Here, an eccentric disk 23 of a motor-driven eccentric acts directly on an elastic element 14 supporting the bearing head 38 of a resilient slat 35. The elastic element 14 has two interconnected spring rings 48, 49, which are oval when seen in a plan view. On it top, the spring ring 49 has a half arc 50 connecting two opposite ring portions to each other. The bearing head 38 of the resilient slat 35 rests on the half arc 50. Laterally, the spring ring 49 is supported, in particular via a plat element 63, on a side profile/longitudinal spar, for example, of the underspringing arrangement or of a bed. By means of outward or inward travel of the eccentric disk 23, the interconnected spring rings 48, 49 are compressed or relaxed, which leads to an upward and downward movement of the half arc 50 and thus of the resilient slat 35. In this embodiment of a stimulation actuator 10, the elastic element accordingly serves directly as a lifting member.

Figure 7:
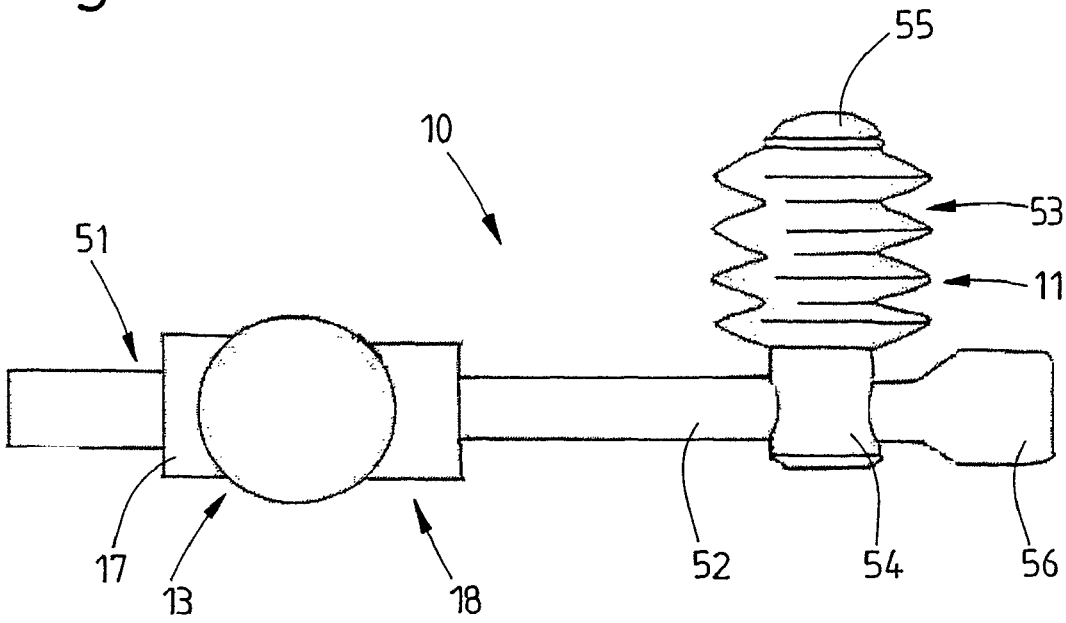
FIG. 7 shows a side view of another embodiment of a stimulation actuator with motor drive.

FIG. 7 shows another embodiment of a stimulation actuator 10 in a side view. A motor housing 13 with gear 17 drives a piston inside a hydraulic cylinder 52 via a spindle 51. The fluid located in the hydraulic cylinder 52 is forced into a bellows-like hollow body 53, which has an elasticity of volume and is connected to the hydraulic cylinder 52 via a connection line 54. On it top face, the bellows-type hollow body 53, which acts as lifting member 11, has a bearing head 55 on which, for example, a resilient slat can be placed. The bellows-type hollow body 53 expands or relaxes as a result of the corresponding strokes of the piston of the hydraulic cylinder 52, which ultimately leads to upward and downward movements of the support element of the underspringing arrangement, for example the resilient slat. If the bellows-type hollow body 53 does not have sufficient elasticity of volume, an air reservoir 56 can additionally be provided as spring element.

Figure 8:
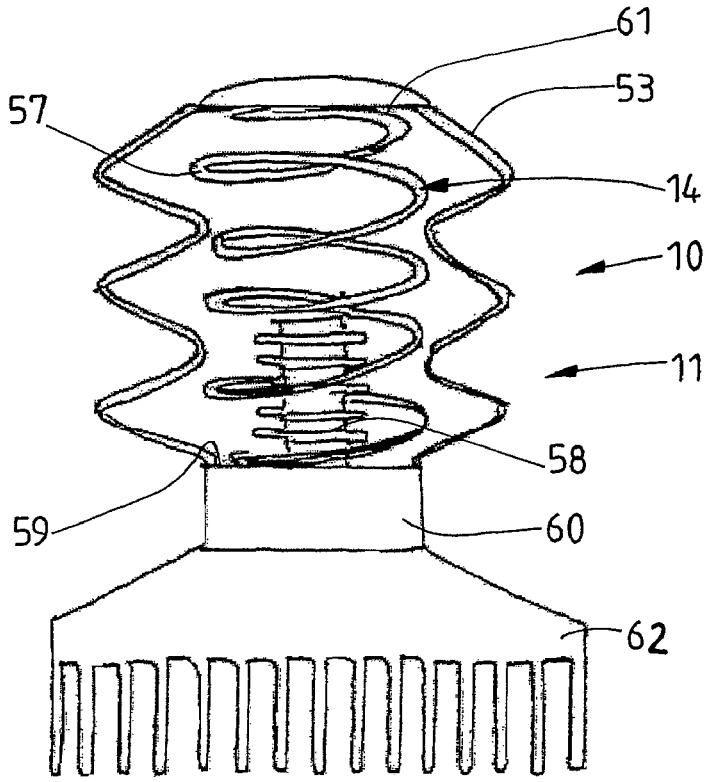
FIG. 8 shows a cross section through a stimulation actuator with shape-memory drive.

FIG. 8, finally, shows a cross section through an embodiment of a stimulation actuator 10 in which it is possible to dispense entirely with a motor drive. A lifting member 11, designed as a bellows-type hollow body 53, has in its interior, as elastic element 14, a torsion spring 57 made of what is called shape-memory metal, for example an NiTi alloy. Alternatively, a bimetal can also be used. The torsion spring 57 surrounds a heating coil 58. The bottom 59 of the hollow body is formed by a cooling surface of a cooling element 60, namely a Peltier element. The torsion spring 57 extends inside the hollow body 53 from the head of 61 of the hollow body of the bottom 59 of the hollow body, that is to say that cooling surface of the Peltier element 60. The Peltier element 60 is adjoined by a further cooling element 62, but a passive one, which is provided with cooling ribs.

By alternate heating and/or cooling of the torsion spring 57, the latter changes its external dimensions, in particular its longitudinal extent. In this way, the head 61 of the hollow body connected to the torsion spring, and consequently the support element of the underspringing arrangement assigned to this head 61, is in each case moved up and/or down.

The individual stimulation actuators can be preferably controlled individually and independently of one another via a control unit (not shown), such that an underspringing arrangement and a mattress or the like resting thereon can perform different lifting movements. Different lifting movements of the mattress are made possible by different programs of the control unit.

Suitable programs of the control unit permit different lifting movements of the mattress or preferably of a part thereof. In the simplest case, all the lifting members are lifted and lowered simultaneously (synchronously), as a result of which the whole mattress is moved up and down perpendicularly, and the shape of the mattress at the surface does not appreciably change. It is also conceivable, by suitable control, for all the lifting members on just one side of the mattress to be lifted or lowered simultaneously, while the lifting members on the other side remain unactuated. This permits an oblique positioning of the mattress or a tilting of the mattress about the longitudinal direction. It is also conceivable to lift all the lifting members on one side and lower all the lifting members on the other side simultaneously. In this way, the mattress can be tilted by a maximum angle.

In another movement program, provision is made for the slats to be lifted and lowered by degrees simultaneously in the longitudinal direction. For this purpose, lifting members assigned at least on opposite sides of a slat are each actuated simultaneously. By consecutive lifting and/or lowering of the slats in the longitudinal direction of the underspringing arrangement, a continuous wave-like movement is generated on the surface of the mattress. Another possibility of moving the mattress involves the lifting members on one side first being lifted individually one after another in the longitudinal direction and then lowered again. After the lifting movement has taken place along one spar element on one side, it is continued on the other side, specifically counter to the longitudinal direction. In this way, the person lying on the mattress experiences a kind of rotation movement. The above-described ways of moving the mattress and of moving the person lying on it can be extended in any desire manner, such that the invention is not limited to the movement possibilities that have been described above. In particular, it is conceivable for the movements of individual lifting members to be superposed in any desired way.

If necessary, it is also possible for the automatic control to be switched off at least momentarily and for the lifting members to be controlled manually. This is preferably done by a person lying on the mattress, who is thus able to control and influence the movements to what he or she feels are the most comfortable. This applies especially in cases where the underspringing arrangement according to the invention is used for treating pain. The travel and/or lifting and lowering speed of the lifting members can also be controlled individually by the control unit. It is also conceivable for the lifting members, or for air springs of similar action, to be arranged as supporting or stimulating elements on the surface of the bed or even to be assigned to the cover sheet. It is also possible to configure the freely programmable control of the lifting members in such a way that it permits feedback. For this purpose, physiological data of the person lying on the mattress, in particular his or her movements, are measured, and the measured values are used by the control unit to control the movements of the lifting members in a specific way. The measurement, for example of the movement of a person lying on the mattress, can be done by determining the internal pressure in the bellows or air admission line to the bellows. The control unit makes it possible, by suitable choice of program, for the lifting members to move the mattress periodically and also irregularly, in particular quasi-periodically. In addition to the aforementioned feedback values, other signals, for example acoustic signals, specifically music signals in particular, can be introduced into the control unit. Visual signals, for example color signals, can also be processed by the control unit when so required.

The underspringing arrangement according to the invention, in particular the control of the movements of the bed, couch or seat generated by the underspringing arrangement, are used for simulation, in particular for basal stimulation, of unconscious patients, patients under ventilation, disoriented patients, somnolent patients, patients with cranial and cerebral trauma, patients with hypoxic brain damage, Alzheimer's sufferers, patients with limited mobility, disabled patients and/or premature babies. The stimulation can be somatic stimulation, vestibular stimulation, vibratory stimulation, oral stimulation, auditory stimulation, tactile/haptic stimulation, visual stimulation, and combinations of the above types of stimulation. The result of the stimulation is principally the alleviation of lack of stimulus. The stimulation by specific movement, in particular of the mattress, serves in particular for prevention of bedsores and/or treatment of bedsores. In addition, the stimulation also serves as a back up in pain treatment and/or for improving perception.

LIST OF REFERENCE NUMBERS

10 stimulation actuator
11 lifting member
12 swivel axis
13 motor housing
14 elastic element
15 tensioning band
16 rotation axis of winding roller
17 gear
18 adjustment actuator
19 tensioning band
20 portion
21 portion
22 axis/rotation axis
23 eccentric disk
24 linear actuator
25 piston element
26 cylinder element
27 end portion
28 swivel axis
29 limit flange
30 torsion spring
31 portion
32 swivel axis
33 spindle drive
34 annular spring
35 resilient slat
36 clip
37 groove
38 bearing head
39 profile
40 bearing arm
41 longitudinal profile
42 toggle
43 toggle joint
44 upper toggle arm
45 lower toggle arm
46 middle toggle arm
47 torsion spring
48 spring ring
49 spring ring
50 half arc
51 spindle
52 hydraulic cylinder
53 hollow body
54 connection line
55 bearing head
56 air reservoir
57 torsion spring
58 heating coil
59 cooling surface
60 cooling element
61 head of hollow body
62 cooling element
63 plate element

The invention claimed is:

1. A stimulation actuator for moving supporting surfaces for sitting on, standing on or lying on, used on mattresses, furniture or the like, which stimulation actuator comprising:

a movable lifting member (11);

an elastic element (14); and a means for driving the lifting member, wherein the lifting member (11) is mounted elastically by means of the elastic element (14), the elastic element (14) being arranged such that at least a main direction of work thereof extends at an angle substantially transversely with respect to the direction of the movement of the lifting member.

2. The stimulation actuator as claimed in claim 1, wherein the elastic element (14) is subjected to a pretensioning.

3. The stimulation actuator as claimed in claim 2, further comprising an adjustment actuator (18) that interacts with the elastic element (14) in such a way that the pretensioning of the elastic element (14) is modifiable.

4. The stimulation actuator as claimed in claim 3, wherein the adjustment actuator (18) has a linear actuator, an eccentric, a crank mechanism or a wound-up band.

5. The stimulation actuator as claimed in claim 3, wherein the adjustment actuator (18) has an electromotive or an electrohydraulic drive or is a shape-memory actuator.

6. The stimulation actuator as claimed in claim 1, wherein the elastic element (14) has a stiffness that is modifiable along the main direction of work.

7. The stimulation actuator as claimed in claim 1, wherein the lifting member (11) has an angled lever that is pivotable about a swivel axis (12, 32) and that has at least two lever arms, of which one lever arm is assigned to the supporting surface for the purpose of moving the supporting surface, and of which the other lever arm is operatively connected to the elastic element (14).

8. The stimulation actuator as claimed in claim 1, wherein the elastic element (14) is a torsion spring (30, 47, 57) selected from the group consisting of helical spring, rubber spring, elastic band, toggle spring, annular spring, hydraulic spring, gas spring and shape-memory spring.

9. The stimulation actuator as claimed in claim 1, wherein the means for driving the lifting member (11) is an electric motor.

10. The stimulation actuator as claimed in claim 9, wherein the lifting member (11) is a bellow-type hollow body (53), and the movement of the bellow-type hollow body (53) is effected via a hydraulic and/or pneumatic drive driven by the electric motor.

11. The stimulation actuator as clamed in claim 10, wherein the bellows-type hollow body (53) has resiliently elastic properties.

12. The stimulation actuator as claimed in claim 9, further comprising a gas spring or air spring system for the spring-mounting of the lifting member (11).

13. The stimulation actuator as claimed in claim 1, wherein the means for driving the lifting member is a shape-memory spring, and the movement of the lifting member (11) is effected by the heating and/or cooling, and resulting changes in dimension, of the shape-memory spring.

14. The stimulation actuator as claimed in claim 13, wherein the shape-memory spring is cooled by a Peltier element (60) assigned to the lifting member (11).

15. The stimulation actuator as claimed in claim 14, wherein the shape-memory spring is arranged inside a thermally insulating bellows-type hollow body (53).

16. A microstimulation system comprising:

at least one stimulation actuators (10) for moving supporting surfaces for sitting on, standing on or lying on, used on mattresses, furniture or the like, which stimulation actuator has a movable lifting member (11), wherein the lifting member (11) is mounted elastically by means of an elastic element (14), the elastic element (14) being arranged such that at least a main direction of work thereof extends at an angle substantially transversely with respect to the direction of the movement of the lifting member; and a central control unit for controlling the at least one stimulation actuators, in which the at least one stimulation actuators are actuated individually and independently of one another via the central control unit and/or the at least one stimulation actuators (10) are movable in different movement patterns via the central control unit.

* * * * *